United States Patent [19]

Petree

[11] 4,384,402

[45] May 24, 1983

[54] TOOL FOR ASSEMBLING CONDUCTORS TO CONNECTOR ELEMENT

[75] Inventor: Edwyn H. Petree, Dunwoody, Ga.

[73] Assignee: Western Electric Company, Inc., New York, N.Y.

[21] Appl. No.: 223,970

[22] Filed: Jan. 12, 1981

Related U.S. Application Data

[62] Division of Ser. No. 71,161, Aug. 30, 1979, Pat. No. 4,282,644.

[51] Int. Cl.[3] ..... H01R 43/04

[52] U.S. Cl. ..... 29/749; 29/750

[58] Field of Search ..... 29/749, 750, 751, 753, 29/566.1, 566.3, 566.4, 564.8, 33 M

[56] References Cited

U.S. PATENT DOCUMENTS

| | | | |
|---|---|---|---|
| 3,837,211 | 9/1974 | Gress | 29/751 X |
| 3,845,535 | 11/1974 | Oder | 29/749 |
| 3,858,158 | 12/1974 | Henn et al. | 339/99 R |
| 3,972,101 | 8/1976 | Casey | 29/749 |
| 4,099,822 | 7/1978 | Carlisle | 339/98 |
| 4,148,138 | 4/1979 | Becker et al. | 29/749 |

*Primary Examiner*—William R. Briggs

*Attorney, Agent, or Firm*—E. W. Somers

[57] ABSTRACT

A tool for assembling a plurality of conductors into secured engagement with a mandrel of a multicontact electrical connector includes a plurality of spaced combs which are positioned adjacent a nest to hold the conductors transversely above a mandrel which is supported in the nest. In each cycle of operation, a head of the tool is prepositioned with respect to the nest and moved into engagement with the conductors to cause a forming die of the head to partially form the conductors about the mandrel and cooperate with a blade adjacent the nest to sever excess lengths of free end portions of the conductors. The head is repositioned with respect to the next so that when the head is again moved, in a second step of the cycle, forces are applied which are sufficient to form the conductors completely about the mandrel with each conductor being pressed into secured engagement with an associated recess on each side of the mandrel.

4 Claims, 11 Drawing Figures

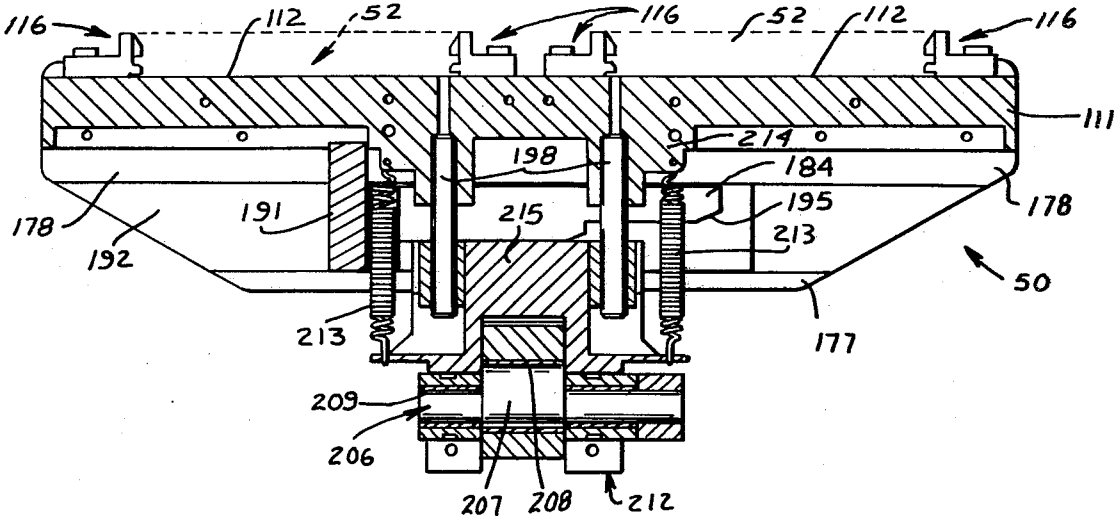
Fig. 7
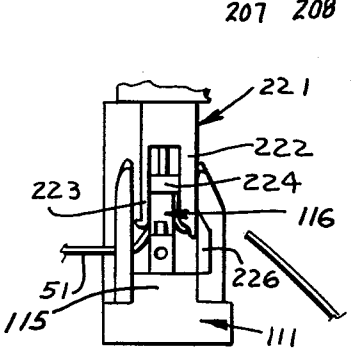
Fig. 8
Fig. 9
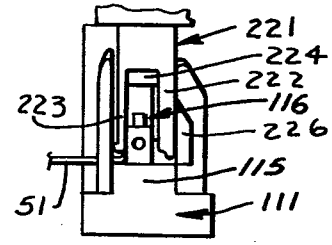
Fig. 10

TOOL FOR ASSEMBLING CONDUCTORS TO CONNECTOR ELEMENT

This is a division, of application Ser. No. 071,161 filed Aug. 30, 1979, U.S. Pat. No. 4,282,644.

TECHNICAL FIELD

This invention relates to a tool for assembling conductors to a connector element, and more particularly, to a hand-operated tool which may be used in field and factory environments to assemble the free end portions of the insulated conductors into secured engagement with a mandrel of a multiple contact element connector.

BACKGROUND OF THE INVENTION

A number of different devices have been available for use in the communications industry to connect corresponding conductors of two cables at a splice location. As the number of conductors to be connected together in any one application increased, the industry resorted to multiple contact connectors such as those shown, for example, in U.S. Pat. No. 3,858,158, which issued Dec. 31, 1974 in the names of Henn et al and in U.S. Pat. No. 4,099,822 which issued July 11, 1978 in the names of A. W. Carlisle and D. R. Frey. It has been estimated that over one billion pair splice conections, for example, are made each year by the telephone industry and a majority of these are made with connectors which are disclosed in the above-identified patents and which include double ended, slotted beam contact elements.

The connector disclosed in U.S. Pat. No. 4,099,822 which is commonly referred to as a modular connector and which is specially designed to mass terminate intra-bay and inter-bay wiring in telephone central offices and to bridge as well as to splice cables, lends itself well to new equipment installation, equipment retrofits, in-service equipment cutovers and equipment moves for reuse. In the use of this connector, insulated conductors of a first cable which are to be connected to conductors of a second cable are formed about mandrels which are received in opposed openings of a plastic receptacle. Similarly, the conductors of the second cable are formed about mandrels which are received in another receptacle after which the receptacles are joined through a connector module which includes a plurality of the contact elements.

One of the important steps in an efficient connectorization process is the simultaneous assembly of a plurality of the insulated conductors to the mandrels. This must be accomplished in such a way that the conductors are trimmed to length and inserted into appropriate conductor-receiving portions of the mandrels so that they remain secured to the mandrels as the mandrels are handled and assembled to the connector module.

It should be apparent that a tool which is used to assemble conductors to a connector mandrel must be portable and uncomplicated, yet it must be capable of imparting sufficient forces to the conductors to secure them to the mandrels within associated tight-fitting recesses as well as being capable of severing excess lengths of the conductors. One commercially available tool for assembling multiple contact connectors and conductors which is operated by compressed air requires excessive support equipment and is cumbersome, thereby making its use in manholes, on telephone poles and in crowded central offices awkward.

A hand-operated tool for assembling multiple contact stackable connectors is shown, for example, in U.S. Pat. No. 3,972,101 and includes a support for elements of a connector and a head which is mounted on the tool and operated to seat the conductors in terminals of a connector element held in the support. In another hand-operated tool shown in U.S. Pat. No. 4,148,138 which issued on Apr. 10, 1979, a tool head is automatically positioned with respect to each stage of assembly of a stackable connector to control the application of forces required at each stage.

The prior art seemingly does not include a hand-operated tool for trimming conductors to length while assembling the conductors to an element of a connector by forming the conductors about the connector element. Such a tool would overcome the obvious lack of economy in a sequence of steps which includes the attaching of the conductors to the element and the subsequent trimming of the conductors to length. However, such a tool must be able to trim the conductors and form them while preventing their movement relative to the connector element.

SUMMARY OF THE INVENTION

The foregoing problems are overcome by a tool in accordance with this invention which secures simultaneously a plurality of conductors to a connector element.

A tool for assembling a conductor to a connector element comprises a support for holding the connector element during its assembly with the conductor and facilities for applying forces to the conductor and supported element to assemble the conductor to the element. Facilities are provided adjacent at least one side of the connector element for holding the conductor transverse of the connector element. A forming means including a cavity that is adapted to receive at least a portion of the connector element for forming the conductor about the connector element is mounted for movement to a position which is spaced a predetermined distance from said support to cause the portion of the connector element to be received in the cavity and the conductor to be formed about the connector element. Means are provided for prepositioning the mounting means to render the forming means capable of being moved to within the predetermined distance of the support. Subsequent to the prepositioning of the mounting means, facilities are rendered effective for moving the forming means to the position which is spaced the predetermined distance from the support.

In order to secure a plurality of insulated conductors to each of two mandrels of a connector, which are insertable into receptacles of the connector, and to remove excess end portions of the conductors, an installer uses a tool which comprises a support for holding the mandrels during a sequence of steps of a cycle of operation. The tool comprises a head for applying forces to the conductors to secure them to the mandrel and facilities for mounting the head to allow movement of the head in one direction to positions spaced first and second predetermined distances from the support and in an opposite direction away from the support. The head is moved manually toward the support to allow one increment of height of a stepped slideably moveable member to be interposed between the mounting facilities for the head and the support so that the head can be moved to a position at which it is spaced the first predetermined distance from the support to engage conductors transversely spanning the mandrels, to begin the forming of each of the conductors into a U-shaped configuration about the mandrels and to sever excess lengths of free end portions of the conductors. Then the slideably moveable member is moved to interpose another increment of height between the mounting facilities and the support so that the head can be moved to the position which is spaced the second predetermined distance from the support to complete the forming of the conductors about the mandrels so that they will be retained in tight fitting recesses in the mandrels.

BRIEF DESCRIPTION OF THE DRAWINGS

Other features of the present invention will be more readily understood from the following detailed description of specific embodiments thereof when read in conjunction with the accompanying drawings, in which:

FIGS. 5–7 are front elevational views which are partially in section and which show three successive positions of a slide which spaces the head for movement at levels which are predetermined distances above the nest; and FIGS. 8–10 are a sequence of views which show the nest, mandrel, conductor and a forming die of the tool head at successive stages of the assembly of the conductors to the mandrel.

DETAILED DESCRIPTION

Figure 1:
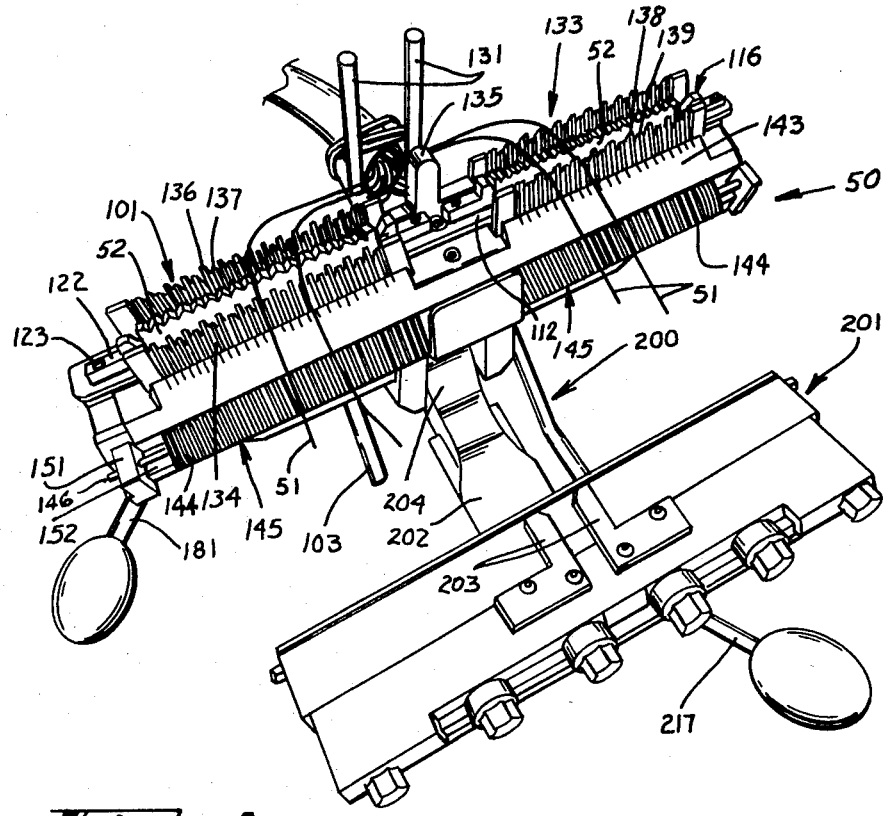
FIG. 1 is a perspective view of a hand-operated tool made in accordance with this invention for assembling insulated conductors to mandrels of a stackable, multi-contact connector.

Referring now to FIG. 1, there is shown an apparatus, designated generally by the numeral 50, for assembling a plurality of insulated conductors 51-51 to an element 52 of a connector system. The element 52 which is commonly known as a mandrel and other elements of the connector system are disclosed in U.S. Pat. No. 4,099,822 which issued July 11, 1978 in the names of A. W. Carlisle and D. R. Frey.

Figure 2:
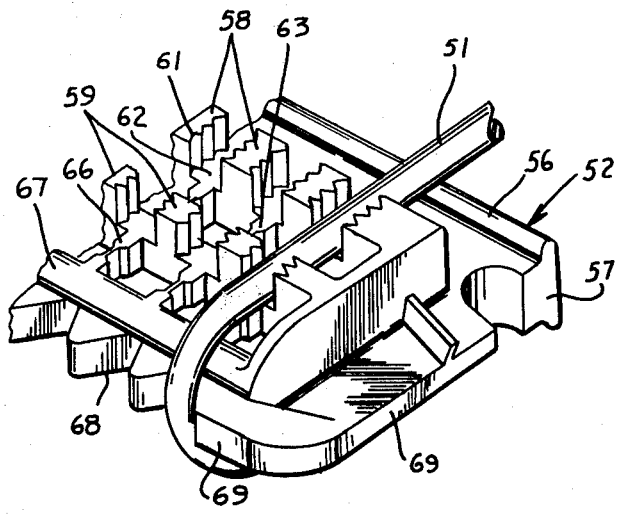
FIGS. 2 and 2A are a perspective view and end section view, respectively, of a mandrel having a plurality of insulated conductors assembled thereto by the tool of this invention.
Figure 2A:
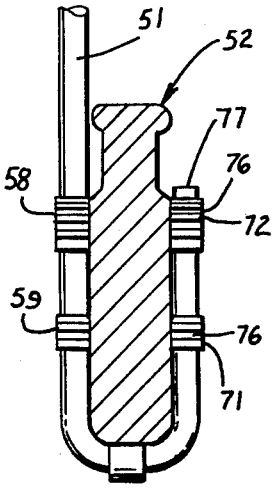

In the connector system which includes the mandrel 52 and which is particularly suited to splicing and to mass connecting operations, conductors 51-51 to be joined to others are dressed about the two-sided mandrel 52. The mandrel 52, which is made of a plastic material, is essentially symmetrical about a center plane and is configured to have a plurality of the insulated conductors 51-51 in looped-around fashion as shown in FIGS. 2 and 2A. The conductors 51-51 could be uninsulated, but more usually are insulated, especially in telephone applications.

Each insulated conductor 51 extends across a surface 56 of a rail 57, and in an associated guide channel between pairs of risers 58-58 and a second pair of risers 59-59, all risers having insulation-gripping surfaces in the form of wire-gripping teeth 61-61. Each conductor 51 is supported in this position by a floor 62 which runs between both pairs of risers 58-58 and 59-59 and which includes reduced width sections 63 and 66. The conductors 51-51 are led around a curved surface 67 and into wire guides 68-68 which are formed as indentations in a shoulder 69 extending around the periphery of the mandrel 52. Thereafter, on the other side of the mandrel 52, each conductor 51 engages mirror image counterparts of the elements just described, including riser pairs 71-71 and 72-72, a floor 73 and conductor-gripping teeth 76-76.

Each mandrel 52 is received in the interior chamber of a holder which is called a receptacle and which is double-sided to accommodate two mandrels. The subsequent assembly of the mandrel, receptacle and a connector module to another receptacle is well disclosed in the above-identified U.S. Pat. No. 4,099,822. The looping of the conductors 51-51 about the mandrel 52 offers the advantage that access for a contact element is provided on each major side of the receptacle. This arrangement offers considerable flexibility in that a connector block can be added to either or both sides of the receptacle to form a stacked connector.

In some applications, the conductors 51-51 may be severed at the point denoted 77 in FIG. 2A, while in other applications, they may be looped fully around the mandrel 52 and terminated at some remote point. For the arrangement shown in FIG. 2A, the severance of excess lengths of the conductors 51-51 must be accomplished with precision so that the ends of the conductors occur at the point 77 with respect to the mandrel 52. If the end portions extend beyond the point 77, adjacent conductors 51-51 could touch and possibly short out, and if they do not extend to the point 77, contact elements which protrude into the receptacle may not engage the conductors.

Referring now to FIGS. 1 and 3–5, the tool 50 includes a nest for holding two longitudinally aligned mandrels 52-52. The nest is provided by a holding bracket assembly 101 mounted in a frame which is designated generally by the numeral 102, that is supported on a pedestal 103 upstanding from a base 106. For use in a central office, the tool 50 may be supported by connecting the pedestal 103 to portions of the framework on which switching or other equipment is mounted.

The holding bracket assembly 101 includes a mandrel support bar 111 having a T-shaped configuration and having a surface 112 along a top of a stem portion 115. In order to hold the mandrels 52-52 on the support bar 111 and prevent unintended lateral and longitudinal movement of them, the holding bracket assembly includes two spaced sets of abutments in the form of pawls, designated generally 116-116. Each of the pawls 116-116 is L-shaped and has a groove 117 formed along a vertically extending portion 118 thereof. The pawl 116 has an opening formed through a base portion 122 thereof with fastener 123 extending through the opening and turned into an opening in the support bar 111. The support bar 111 also includes an elongated opening 126 in the base 111 for receiving a key 127 extending downwardly from the underside of the pawl 116. The pawl 116 also includes a compression spring 128 which is attached to the fastener 123 and biases the pawl inwardly toward a center of the associated nest.

When a mandrel 52 is positioned in a nest, the shoulder 69 at each end of the mandrel is received in the associated groove 117 of the pawl at each end of the mandrel. The pawls 116-116 are urged apart and the compression springs overcome to permit insertion of the mandrel 52. Once the mandrel 52 is in engagement with the surface 112, the springs 128-128 bias the pawls 116-116 into engagement with the mandrel 52 to retain it within the nest.

The holding bracket assembly 101 also includes facilities for holding an end portion of a cable and the conductors 51-51 preparatory to the assembly of the conductors with the mandrels 52-52. Two guide posts 131-131 (see FIGS. 1, 3 and 4) which project upwardly from an ear 132 of the frame 102 are adapted to receive an end portion of a cable from which the jacket has been removed to expose the individually insulated conductors 51-51. In order to hold the conductors 51-51, a comb 133 and a comb 134 are positioned on opposite sides of each nest with aligned spaces formed between adjacent teeth 136-137 and 138-139 of the combs on opposite sides of the support bar 111. Positioned between the combs 133-133 and upstanding from the support bar 111 is a stop 135. The comb 133 rests on a top surface 141 of a crosshead 142 of the T-shaped support bar 111 and is fastened to a side surface of the stem 115. The other comb 134 rests on the top surface 141 on the opposite side of the crosshead 142 and is fastened to the side surfaces of the stem 115.

In order to have the conductors 51-51, during initial distribution along the nest, first engage the combs 133 and 134 to align them with the mandrels 52-52, the teeth 136-137 of the combs extend farther above the support bar 111 than do the mandrels. Further, the combs 133-133 and 134-134 are arranged such that when an installer inserts conductors 51-51 therein, the conductors are aligned with the wire guides 68-68 along the tops of mandrels 52-52 which are held in the nests.

Free end portions of the conductors 51-51 extend beyond the combs 134-134, inclined downwardly along a sloped surface 143 (see FIG. 1) of a transition bar 140 (see FIGS. 3 and 4) attached to the top surface 141 of the crosshead 142 of the support bar 111. The free end portions of the conductors 51-51 are retained between adjacent convolutions 144-144 of springs 145-145 which are supported along a rod 146 that extends along one side of the base 111. Each spring 145 includes a collar at each end with the collar being retained against further movement inwardly of the nest by a stop (not shown) that is attached to the rod 146. This arrangement permits each end of each spring 144 to be moved outwardly from the center of the spring so that conductor loading of the spring can progress in any direction. The rod 146 is supported at each end in a bearing 151 while the underside of its convolutions rest in engagement with a ledge 152 (see FIG. 1) that extends between and is integral with the bearings.

The ledge 152 is attached to a rear apron 161 (see FIGS. 3 and 4) of the frame 102 that is fastened to the crosshead 142 of the T-shaped bar 111. The rear apron 161 includes a channel 163 formed between a lower rail 164 and an upper rail 166 that is in engagement with an underside of the crosshead 142. In order to accommodate provisions for adjusting force applying facilities, the rear apron 161 includes a longitudinally extending slot 167 and a centrally disposed opening 168 formed between two downwardly depending portions 169-169.

The frame 102 also includes a frontal apron 171 (see FIGS. 4 and 5) having a laterally extending portion 172 for receiving an upper end of the pedestal 103. An interiorly facing channel 176 formed between a lower rail 177 and an upper rail 178 of the apron 171 cooperates with the channel 163 to provide a guideway for facilities which control the application of forces to the conductors 51-51. A top surface of the upper rail 178 of the frontal apron 171 cooperates with a top surface of the upper rail 166 of the rear apron to support the bar 111.

The longitudinally extending slot 167 in the rear apron 161 is adapted to receive a handle 181 which is attached to a slide 182 that is mounted slideably within the guideway formed between the two channels in the aprons 161 and 171 (see FIGS. 1 and 3–5). The handle 181 is adapted to extend angularly through the slot 167 adjacent one end 183 of the slide. Outward movement of the slide 182 is prevented by an end wall 184 which depends from the support bar 111 at one end thereof. The slide 182 is box-like and is formed by an end wall 191 which spans between two side walls 192 and 193 that ride in the channels 163 and 177. Each of the side walls 192 and 193 includes inwardly facing steps 194 and 196 with the step 194 having a tapered end portion 195. The slide 182 is designed to occupy any one of three positions between the aprons 161 and 171 which are designated "LOAD", "CUT" and "PRESS".

In order to support force-applying facilities to be described hereinafter, the top support bar 111 includes a pair of downwardly depending anvil portions 197-197 (see FIG. 5) which are disposed between the upper rails 166 and 178 of the rear and frontal aprons, respectively. Further, a pair of rods 198-198 are mounted in and depend downwardly from the anvil portions 197-197.

The tool 50 also includes force-applying facilities such as a T-bar assembly, designated generally by the numeral 200 (see FIG. 1), which during the positioning of the mandrels 52-52 in the nests is disposed below the frame 102 (see FIG. 3). The T-bar assembly 200 includes a head 201 which during each sequence of steps in a cycle of the operation of the tool is moved to a position where it is spaced a first predetermined distance from the surface 112 of the bar 111 to engage the conductors 51-51 which span transversely across the mandrels 52-52 that are held in the holding bracket assembly 101 to partially form the conductors about the mandrels and to sever excess end portions of the conductors. The T-bar assembly tool 200 is also capable of moving the head 201 to a position that is spaced a second predetermined distance from the surface 112 to complete the formation of the conductors 51-51 into a generally U-shaped configuration about the mandrels 52-52. The T-bar assembly 200 is also mounted for pivotal movement between the positions shown in FIGS. 3 and 4 to expose the support surface 112 to allow insertion of the mandrels 52-52 into their nests, and the initial positioning of the conductors 51-51.

This capability is provided by a connecting arm 202 which extends arcuately from the head and which is connected to the frame 102. The pivotal movement of the T-bar assembly 200 counterclockwise, as viewed in FIG. 4, is limited by the stop 135 which engages a lower portion of the head 201 between two spaced side bars 203-203. A lower, hub portion 204 of the arm 202 has an opening 205 therethrough with a bearing 210 for receiving a cam shaft 206 (see FIGS. 3–5) that is eccentrically mounted with respect to the opening. The cam shaft 206 has an enlarged center portion 207 with a lobe 208 and two end portions 209-209 which have a circular cross section. The end portions 209-209 are supported in bearings 211-211 of a cam shaft support or bracket assembly, which is designated generally by the numeral 212 and which is supported for reciprocal motion along the downwardly depending rods 198-198. The cam shaft support assembly 212 is arranged so that the lower end 204 of the arm 202 through which the cam shaft 206 extends is disposed upwardly between the downwardly depending portions 169-169 of the rear apron 161 of the frame 102.

The cam shaft support assembly 212 also includes a die block 215 that cooperates with the slide 182 to space the head 201 relative to the support surface 112 to provide for the effective application of forces to the conductors. The die block 215 normally is biased upwardly toward engagement with or adjacent to the anvil portions 197-197 by a pair of tension springs 213-213 that are attached at their upper ends to stepped portions 214-214 that extend laterally from the anvil portions.

Figure 3:
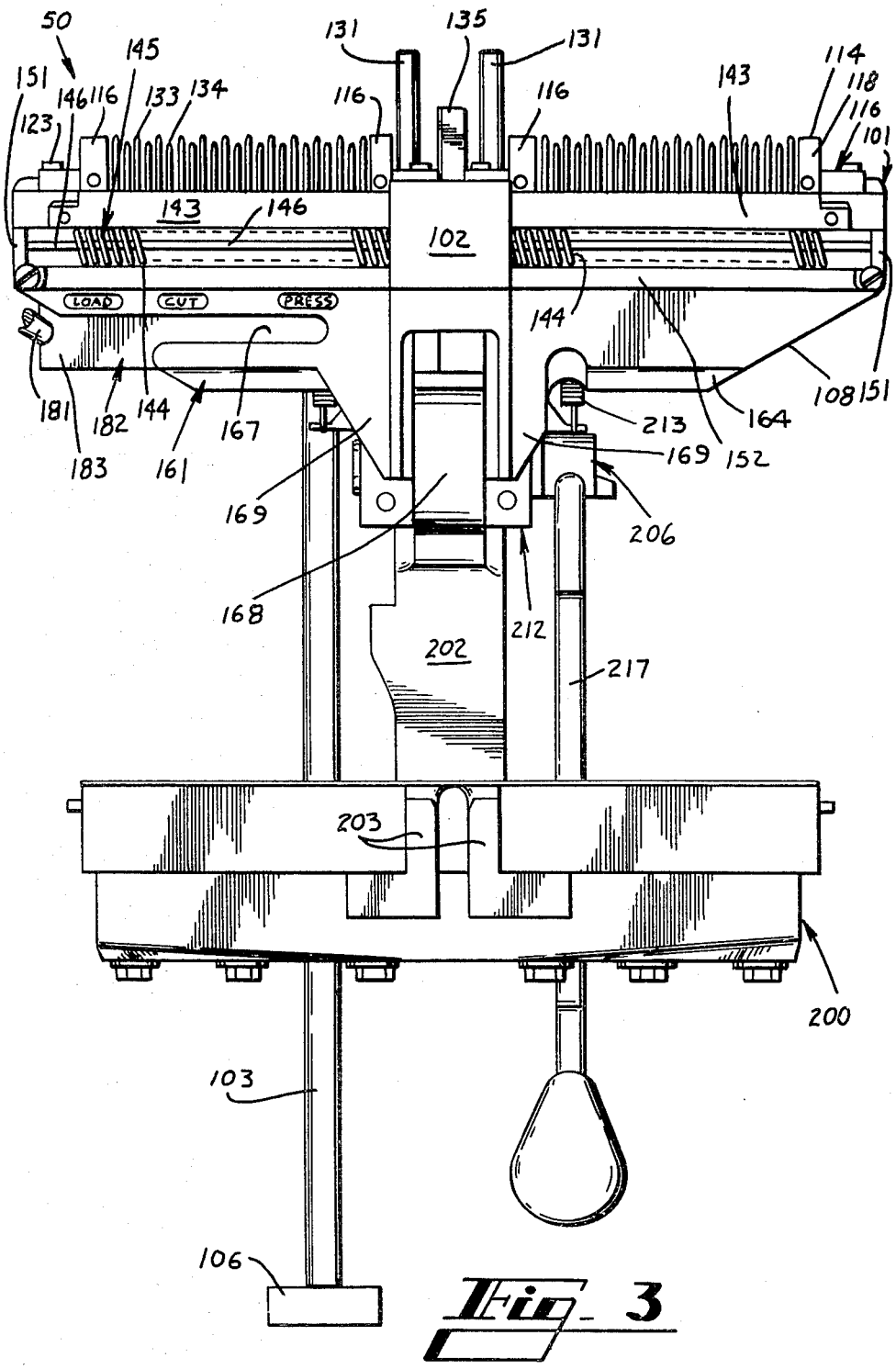
FIG. 3 is a front elevational view of the tool of FIG. 1 with a head thereof being in a position to uncover a nest for receiving the mandrels.
Figure 4:
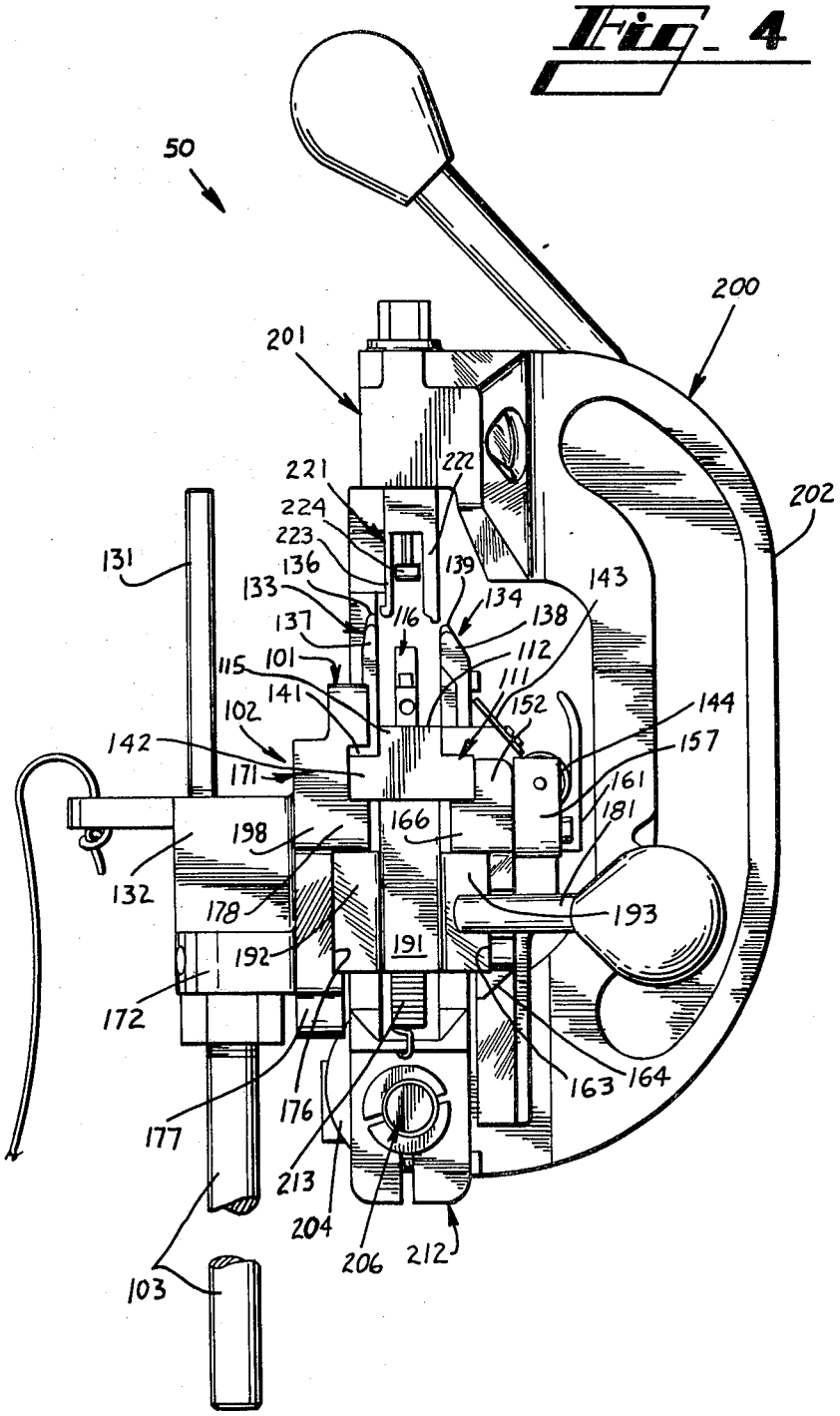
FIG. 4 is a side elevational view of the tool of FIG. 1 with the head of the tool positioned above the nest which holds two mandrels.
Figure 5:
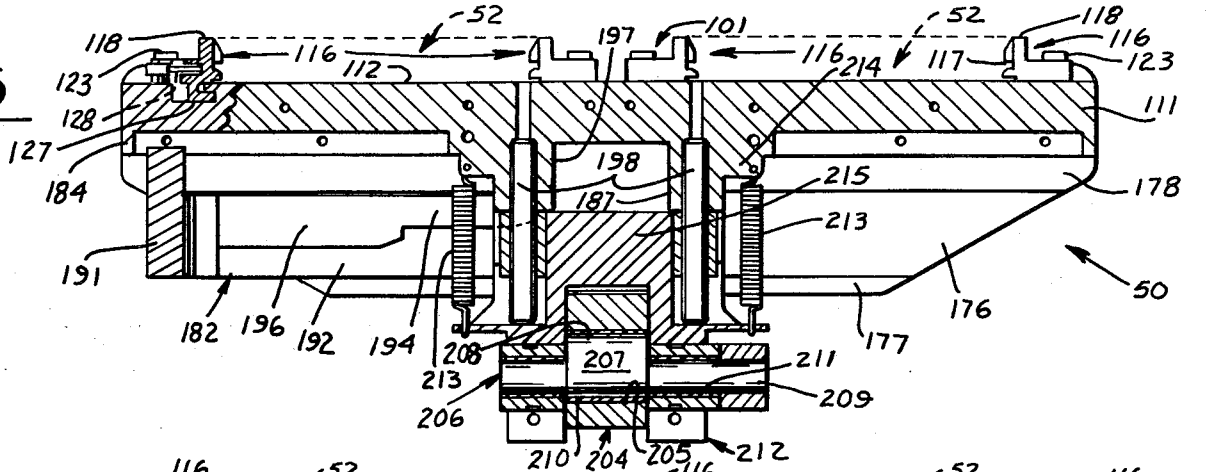
Figure 6:
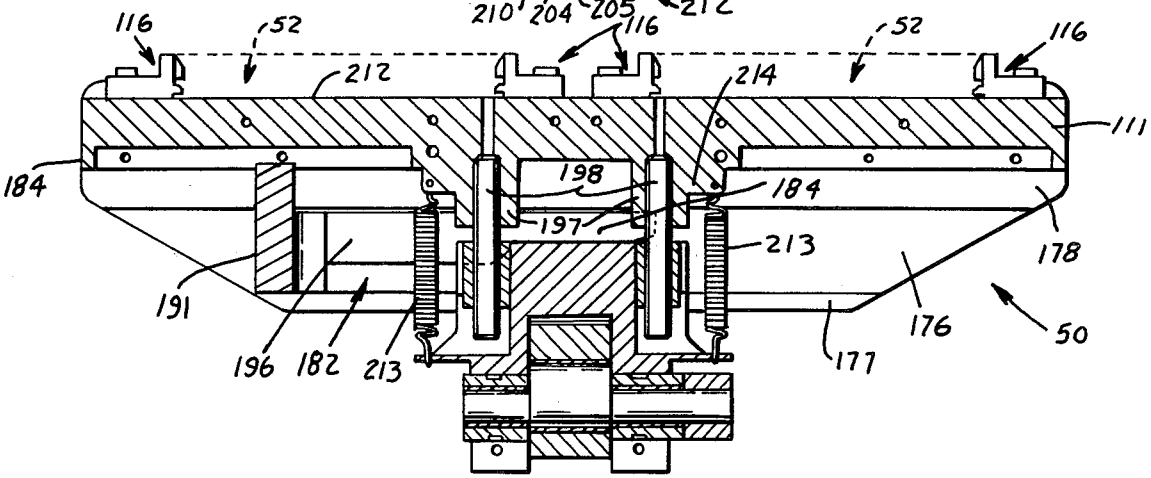

As can best be seen in FIGS. 3 and 5, one end of the cam shaft 206 extends beyond the adjacent portion 169 of the frame 171 and has a handle 217 attached thereto. The handle 217 can be moved pivotally independently of the T-bar assembly 200, but its movement is effective to turn the cam shaft 206 and thereby turn the lobe 208 to cam the head 201 downwardly while the bracket assembly 212 is held by the springs 213-213 in engagement with the interposed slide 182.

The head 201 includes a forming die 221 (see FIGS. 4 and 8) which includes depending legs 222 and 223, that are spaced apart as they extend longitudinally along the underside of the head, and an inner adjustably mounted bar 224. The spacing between the legs 223 and 224 is slightly greater than the side-to-side dimension of the mandrel 52.

As it is moved from a rest position to a work position spaced a first predetermined and then a second predetermined distance above the surface 112, the forming die 221 is effective to apply forces to the conductors 51-51 to move the conductors past the cutting blade to cut end portions of the conductors to length so that they are formed into secured engagement with the mandrels 52-52. One of the depending legs 222, i.e. the one adjacent the rear apron 161 when the head 201 is in an operative position above the support bar 111, cooperates with a blade 226 (see FIGS. 4 and 8) that is received in recesses in the combs 133-133 to sever the excess lengths of the conductors 51-51. The forming die 221 and the blade 226 are arranged so that the length of the free end portion of each conductor after severance will extend from the guide 68 to the lower recess of the mandrel 52.

In a cycle of operation, an installer moves the T-bar assembly 200 pivotally to uncover the nests and then inserts a mandrel 52 between each pair of retainer pawls 116-116 and in engagement with the surface 112. Then the installer positions an end of a cable between the upstanding posts 131-131 and places a conductor 51 between a pair of convolutions 144-144 of each spring 145 and then across the two combs 133 and 134 with each conductor extending through aligned recesses between the comb teeth 136-137 and 138-139.

After all conductors 51-51 have been fanned out and are held in the springs 145-145 and combs 133-133 and 134-134, the installer moves the head 201 pivotally into the position above the mandrels 52-52 (see FIG. 4). The installer uses one hand to move the T-bar assembly 200 downwardly by overcoming the tension in the springs 213-213, and with the other hand moves the slide 182 to the right as viewed in FIG. 3 from the "LOAD" to the "CUT" position at which time the shallow step 194 is received between the anvil portion 197-197 and the underside of the top rails 166 and 178 of the rear and frontal aprons 161 and 171, respectively. At this time, the depending portions 122 and 123 of the forming die 221 are in engagement with the conductors 51-51. Upon release of the T-bar assembly 200, the die block 215 engages the steps 194-194 of the slide 182 to space it from the anvil portions 197-197. This also causes the head 201 to be capable of being moved to within a first predetermined distance of the support surface 112 as the cam lobe 208 is turned through an angle of approximately 180°. The handle 217 which is connected to the cam shaft assembly is turned clockwise as viewed in FIG. 4 through an angle of about 180°. This causes the support assembly 212 to be moved downwardly to space the lowermost portion of the head 201 the first predetermined distance from the surface 112. The forming die 221 is moved relative to the mandrel 52 and the combs 133 and 134-134 to cause the die 221 to begin the forming of the conductors 51-51 about the mandrels 52-52 and to cause the portion 222 to cooperate with the blades 226-226 to sever the excess free end portions of the conductors. The length of the end portion of each conductor 51 which is removed is such that the conductor when completely formed about the mandrel 52 is dressed thereabout in the U-shaped configuration shown in FIG. 2A.

In a next step in a cycle of operation, the installer uses one hand to return the handle 217 to the initial position shown in FIG. 4 while using the other hand to maintain the head 201 in its partial-form and cut position. As the handle 217 is turned clockwise as viewed in FIG. 4 with the head 201 held, the axis of the cam shaft 206 remains in an essentially constant position. The lobe 218 on the center portion 207 of the cam shaft 206 is moved from a bottom dead center position to a top dead center position shown in FIG. 7 and applies forces to the bracket assembly 212 to move it downwardly along the rods 198-198. This causes the assembly 212 to be spaced farther from the anvils 197-197 to permit additional inward movement of the slide 182 to the "PRESS" position whereupon the next, deeper step 196 is moved between the top rails 167 and 178 and the die block 215 (see FIG. 7). This, of course, decreases the distance within which the forming die 221 can be moved toward the support surface 112 so that subsequent movement of the handle 217 and head will apply further forces to the conductors to complete their formation about the mandrels. The distance between the lowermost portion of the head 201 and the support surface 112 after the head has been operated to completely form the conductors 51-51 about the mandrels 52-52 is referred to as the second predetermined distance and approaches zero in magnitude.

It is important to recognize the advantage in using a two stage sequence to sever and then to completely form the conductors 51-51. With the cam arrangement for mounting the arcuate arms 217, maximum mechanical advantage is derived when the arm has been rotated through approximately 180° with the minimum about 90°. If a single 180° turning of the arm were to be used, the cutting and partial forming would have to occur when the arm had been turned through about 90°. With a minimum mechanical advantage corresponding to a 90° angle, the tool 50 may not be capable of severing end portions of a plurality of conductors 51-51 simultaneously. In the arrangement of this invention, the function of the forming die 221 at each step, i.e. form and cut, then completely form, occurs as the handle 217 reaches the lowermost position of its sweep which advantageously corresponds to the point of maximum mechanical advantage.

After the conductors 51-51 have been cut and the end portions thereof formed about the mandrels 52-52, the handle 217 is returned into engagement with the head 201, the slide 182 returned to the "LOAD" position, and the T-bar assembly moved clockwise as viewed in FIG. 4 to uncover the nests to permit removal of the conductor-loaded mandrels.

As noted hereinbefore, there may be situations which demand that the conductors 51-51 be formed about the mandrel without having their end portions severed. In those situations, the installer removes the blades 226-226 from the recesses within the combs 134-134 and operates the tool 50 in a two step operation as before to partially, then completely form the conductors 51-51 about the mandrels 52-52.

It is to be understood that the above-described arrangements are simply illustrative of the invention. Other arrangements may be devised by those skilled in the art which will embody the principles of the invention and fall within the spirit and scope thereof.

What is claimed is:

1. A tool for assembling a plurality of conductors to a connector element, said tool comprising:

a support for holding an elongated connector element having a generally rectangular cross-section and having conductor-receiving recesses formed along sides thereof;

means disposed on at least one side of said support for holding a plurality of conductors transverse of the connector element and aligned with conductor-receiving recesses of the connector element preparatory to the conductors being secured to the connector element;

forming means including a cavity that is adapted to receive at least a portion of the connector element for causing an end portion of each conductor to be formed into a generally U-shaped configuration about the connector element with portions of each conductor being received within an associated aligned one of the conductor-receiving recesses;

means connected moveably to said support for mounting said forming means for pivotal movement from an open position to a position which is spaced a predetermined distance from said support to cause the portion of the connector element to be received in said cavity and the conductor to be formed about the connector element;

means for prepositioning said mounting means to cause said forming means to be capable of being moved to within at least two predetermined distances of said support; and means rendered effective subsequent to the prepositioning of said mounting means for moving said forming means toward said support to a position which is spaced a first predetermined distance from said support to form the conductor end portions partially about the connector element and for then moving said forming means to a position which is spaced a second predetermined distance from said support to form the conductor end portions completely about the connector element in a generally U-shaped configuration.

2. The apparatus of claim 1, wherein said prepositioning means comprises a slidably moveable member which in a cycle of operation is interposed between said mounting means and said support to cause said forming means to be capable of being moved to the positions which are spaced said predetermined distances from said support.

3. The apparatus of claim 2, wherein said forming means includes a head, an arm that extends from one end to another in a generally arcuate configuration, said head being attached to said one end of said arm, a cam shaft having said other end of said arm mounted thereon, a lever attached to said cam shaft, and a bracket assembly which is biased toward engagement with said support, said cam shaft being mounted in said bracket assembly, and said slideably moveable member capable of being interposed between said bracket assembly and said support to space said cam shaft farther from and said forming means closer to said support.

4. The apparatus of claim 3, wherein each cycle of operation includes a sequence of steps and wherein said slideably moveable member is configured so that after each successive step it is repositioned between said support and said bracket assembly to cause a greater portion of said connector element to be moved into said cavity so that successive steps in the cycle of operation cause the conductors to be formed completely about said element.

* * * * *